US011541669B2

(12) United States Patent
Ito et al.

(10) Patent No.: US 11,541,669 B2
(45) Date of Patent: Jan. 3, 2023

(54) WINDING SPOOL, RE-TRANSFER FILM SET, AND IMAGE FORMING APPARATUS

(71) Applicant: CANON FINETECH NISCA INC., Saitama (JP)

(72) Inventors: Shoji Ito, Saitama (JP); Toshirou Fujimoto, Yamanashi (JP)

(73) Assignee: Canon Finetech Nisca Inc., Saitama (JP)

( * ) Notice: Subject to any disclaimer, the term of this patent is extended or adjusted under 35 U.S.C. 154(b) by 47 days.

(21) Appl. No.: 17/158,841

(22) Filed: Jan. 26, 2021

(65) Prior Publication Data

US 2021/0146698 A1 May 20, 2021

Related U.S. Application Data

(63) Continuation of application No. PCT/JP2020/022926, filed on Jun. 10, 2020.

(30) Foreign Application Priority Data

Jun. 13, 2019 (JP) ..... JP2019-110686

(51) Int. Cl.
*B41J 2/325* (2006.01)
*B65H 75/14* (2006.01)

(52) U.S. Cl.
CPC ..... *B41J 2/325* (2013.01); *B65H 75/14* (2013.01)

(58) Field of Classification Search
CPC . B41J 2/325; B41J 33/003; B41J 2/315; B41J 2/32; B65H 75/14; B65H 18/103; B65H 27/00; B65H 23/1806; B65H 2404/4213; B65H 2701/1752; B65H 2801/15; B65H 2801/03; B41F 16/00; B41F 16/0006; B41F 16/0026; B41F 16/0033
See application file for complete search history.

(56) References Cited

U.S. PATENT DOCUMENTS

2015/0124016 A1 5/2015 Bildstein et al. ..... B41J 15/046

FOREIGN PATENT DOCUMENTS

| | | |
|---|---|---|
| JP | S62-133576 U | 8/1987 |
| JP | H08-174874 | 7/1996 |
| JP | 2002-059668 | 2/2002 |
| JP | 2003-002543 | 1/2003 |
| JP | 2015-086075 | 5/2015 |

OTHER PUBLICATIONS

International Search Report and Written Opinion dated Dec. 17, 2020 in parent PCT/JP20202/022926, with partial translation.

*Primary Examiner* — Kristal Feggins
(74) *Attorney, Agent, or Firm* — Venable LLP

(57) ABSTRACT

A re-transfer film set includes: a winding spool including: a first outer diameter portion which supports the re-transfer film and has a first outer diameter, a width of the first outer diameter portion in a direction of the rotational axis being narrower than the width of the re-transfer film; a second outer diameter portion being disposed in the direction of the rotational axis in a position being different from a position of the first outer diameter portion, the second outer diameter portion having a second outer diameter being smaller than the first outer diameter; and a third outer diameter portion being disposed in the direction of the rotational axis on a side opposite to a side of the second outer diameter portion with respect to the first outer diameter portion, the third outer diameter portion having a third outer diameter being smaller than the first outer diameter.

25 Claims, 13 Drawing Sheets

WINDING SPOOL, RE-TRANSFER FILM SET, AND IMAGE FORMING APPARATUS

CROSS-REFERENCE TO RELATED APPLICATIONS

This application is a Continuation of International Patent Application No. PCT/JP2020/022926, filed Jun. 10, 2020, which claims the benefit of Japanese Patent Application No. 2019-110686, filed Jun. 13, 2019, both of which are hereby incorporated by reference herein in their entirety.

BACKGROUND OF THE INVENTION

Field of the Invention

The present invention relates to a winding spool which winds a medium such as a re-transfer film for transferring an image to a recording medium while rotating, a re-transfer film set which includes this winding spool, and an image forming apparatus which includes this re-transfer film set.

Description of the Related Art

Conventionally, image forming apparatuses, each of which forms an image on a recording medium such as a card or a sheet, have been widely known. Each of such image forming apparatuses includes an image forming portion having a thermal head, which is provided with a plurality of heating elements, and a platen such as a platen roller, which is located in such a way as to face the thermal head.

In addition, it is often the case that on each of such image forming apparatuses, color printing which generates a color image by superposing images having a plurality of colors is performed. In the color printing, an ink ribbon which is provided with an ink panel having a plurality of colors and an ink panel having a Bk (black) color as needed, sequentially and repeatedly along a conveying direction is used. Here, the plurality of colors is, for example, Y (yellow), M (magenta), and C (cyan) colors. Note that the Bk ink is used, for example, in a case where a contour is made clear or a case where a monochrome image of a logo, characters or the like is formed.

In addition, such image forming apparatuses, in each of which an indirect printing system (re-transfer system) in which an image is formed on a transfer medium such as re-transfer film by using an ink ribbon and subsequently, the image formed on the transfer medium is transferred to a recording medium is used, have been known. Each of the image forming apparatuses, in which the indirect printing system is used, forms an image on a transfer medium by conveying the transfer medium and the ink ribbon at the same speed while a side of a face opposite to a side of a face of the transfer medium on which the image is formed is supported by the platen and by selectively actuating the heating elements of the thermal head which are pressed against the ink ribbon.

When the color printing is performed by the image forming apparatus having the indirect printing system used therein, according to input pieces of printing data for the plurality of colors or pieces of printing data to which the input pieces of the image data for the plurality of colors are converted, images having the plurality of colors are superposed on the transfer medium to be printed.

In addition, when the so-called marginless printing in which printing is made up to end portions of a card as the recording medium is performed by each of the image forming apparatuses having the indirect printing system used therein, in order to prevent chipping of an image, an image whose size is larger than a size of the card is formed on the transfer medium. Thus, the chipping of the image on the end portions of the card caused by positional deviation of the transfer medium and the card can be prevented.

Here, when an image whose size is the same as the size of the card is formed on the transfer medium, the ink transferred onto the transfer medium is re-transferred onto the card and does not remain on the transfer medium. However, when the image whose size is larger than the size of the card is formed on the transfer medium, ink of portions of the image, up to which printing of the image whose size is larger than the size of the card is made, remains on the transfer medium after the image has been re-transferred onto the card. At this time, there may be a case where depending on the pieces of the printing data, a marginless printing region is caused on only one end portion of the card in the conveying direction and no marginless printing region is caused on another end portion of the card in the conveying direction. In such a case, the ink remains in only the marginless printing region corresponding to a side of the one end portion of the transfer medium.

Used re-transfer film is wound by a winding spool, and in a case where pieces of printing data in a state in which the ink remains in a specific portion such as the one end portion of the card in the conveying direction are successive, when the used re-transfer film is continuously wound by the winding spool, remaining ink other than the ink remaining on the re-transfer film is also layered. This causes difference in outer diameters of the wound-up re-transfer film in a rotational axis direction. Since the re-transfer film is wound while moving to a side on which outer diameters are large, the re-transfer film is pulled to the side on which the outer diameters are large, thereby causing a phenomenon called film biasing. The re-transfer film on which the above-mentioned phenomenon is caused develops creases between the winding spool and a supply spool and causes image chipping and the like, hence incurring a reduction in printing quality.

To address this, Japanese Patent Laid-Open No. 2015-086075 discloses a configuration for correcting the film biasing by providing a portion which detects a film position and a portion which returns film to a center position based on a result of this detection.

However, in Japanese Patent Laid-Open No. 2015-086075, it is required that a roller shaft which conveys the film is configured to be rotatable at only a predetermined angle, and an actuator which rotates the roller shaft, a portion which detects the film position, a portion which controls operation of the actuator, and the like are required. Thus, Japanese Patent Laid-Open No. 2015-086075 has problems in that costs are increased and a size of an apparatus is increased.

SUMMARY OF THE INVENTION

Objects of the present invention are to provide a winding spool, a re-transfer film set, and an image forming apparatus which can prevent film biasing caused by ink remaining on re-transfer film in a simple configuration without increasing costs.

To achieve the objects, in a representative configuration of a re-transfer film set according to the present invention, the re-transfer film set includes: a belt-like re-transfer film which carries an image being transferred from an ink ribbon, is operable to transfer the image to a recording medium, and has a predetermined width; a supply spool which has wound the re-transfer film in such a way as to be operable to send out the re-transfer film to a direction being orthogonal to a direction of the width; and a winding spool which is operable to wind the re-transfer film being sent out from the supply spool while rotating around a rotational axis as a center, the winding spool including: a first outer diameter portion which supports the re-transfer film and has a first outer diameter, a width of the first outer diameter portion in a direction of the rotational axis being narrower than the width of the re-transfer film; a second outer diameter portion being disposed in the direction of the rotational axis in a position being different from a position of the first outer diameter portion, the second outer diameter portion having a second outer diameter being smaller than the first outer diameter; and a third outer diameter portion being disposed in the direction of the rotational axis on a side opposite to a side of the second outer diameter portion with respect to the first outer diameter portion, the third outer diameter portion having a third outer diameter being smaller than the first outer diameter, and in the re-transfer film set, when the re-transfer film being supported by the first outer diameter portion is wound onto the winding spool, in the direction of the rotational axis, one end portion of the re-transfer film in the direction of the width overlaps the second outer diameter portion and another end portion of the re-transfer film in the direction of the width overlaps the third outer diameter portion.

According to the present invention, the film biasing caused by the ink remaining on the re-transfer film can be prevented in the simple configuration without increasing the costs.

Further features of the present invention will become apparent from the following description of exemplary embodiments with reference to the attached drawings.

DESCRIPTION OF THE EMBODIMENTS

Figure 1:
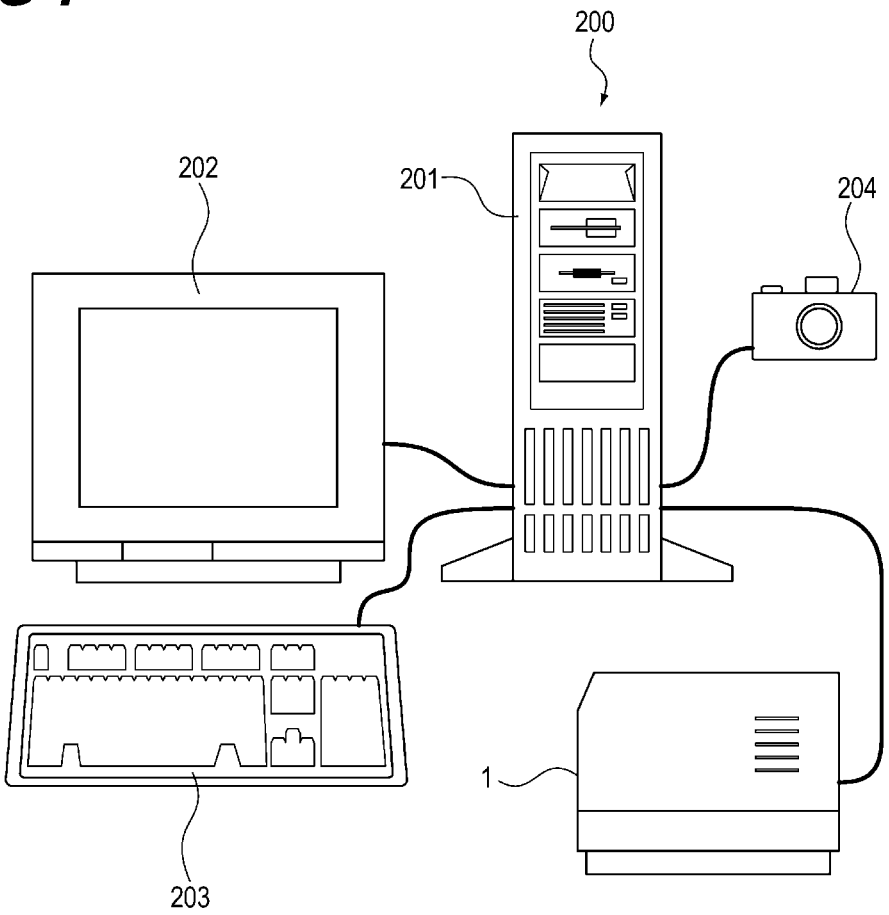
FIG. 1 is a diagram illustrating a configuration of an image forming system according to a first embodiment of the present invention.

Hereinafter, embodiments of the present invention will be described in detail with reference to the accompanying drawings.

First Embodiment

<Configuration of Image Forming System>

A configuration of an image forming system 200 according to a first embodiment of the present invention will be described in detail with reference to FIGS. 1 and 2.

The image forming system 200 includes an image forming apparatus 1, a PC (personal computer) 201, a monitor 202, a keyboard 203 as an input device, an image input device 204, and the like.

The image forming apparatus 1 receives printing data, image data, magnetic or electric recorded data, or the like from the connected PC 201. Based on these received pieces of data, the image forming apparatus 1 forms (prints and records) characters or an image on a card as a recording medium or performs magnetic or electric information recording. Note that detail of the configuration of the image forming apparatus 1 will be described later.

The PC 201 transmits the printing data, the image data, the magnetic or electric recorded data, or the like to the image forming apparatus 1 and issues an instruction to execute recording operation and the like. The PC 201 is not limited to the personal computer and maybe a host computer.

The monitor 202 is connected to the PC 201 and performs display based on the data and the like generated by the PC 201. The monitor 202 is, for example, a liquid crystal display or the like.

The keyboard 203 is connected to the PC 201 and is to input an instruction or data to the PC 201.

The image input device 204 is connected to the PC 201 and outputs image data of an acquired image to the PC 201. The image input device 204 is a digital camera which outputs a shot image as image data, a scanner which outputs an image read from the original or the like as image data, or the like, and here, the digital camera is illustrated as an example.

<Configuration of Image Forming Apparatus>

A configuration of the image forming apparatus 1 according to the first embodiment of the present invention will be described in detail with reference to FIGS. 2 and 3.

The image forming apparatus 1 has a housing 2, and inside the housing 2, an information recording portion A, a printing portion B, a medium supply portion C, a storage portion D, a rotation unit F, an operation panel portion 5, a controller 100, and a power supply portion 120 are included.

The information recording portion A performs magnetic or electric information recording onto a card Ca as a recording medium supplied from the medium supply portion C. The information recording portion A conveys the card Ca, onto which the magnetic or electric information recording is performed, toward the printing portion B.

The printing portion B has a film-state medium conveying mechanism which conveys a transfer film 46 as a re-transfer film. The printing portion B is provided with a carrying-in path P1 through which the card Ca supplied from the medium supply portion C is transported and a carrying-out path P2 through which the card Ca onto which printing has been performed is transported to the storage portion D. The printing portion B includes an image forming portion B1 as an ink transfer portion and a transfer portion B2 as an image transfer portion.

The image forming portion B1 forms an image on the transfer film 46 conveyed by the film-state medium conveying mechanism. The transfer portion B2 re-transfers an image of a face photograph, character data, or the like, which has been formed on the transfer film 46, onto a front surface or the front and back surfaces of the card Ca conveyed through the carrying-in path P1 from the information recording portion A and conveys the card Ca, onto which the image has been re-transferred, toward the storage portion D.

A cassette 18 of the medium supply portion C stores a plurality of cards Ca in such a way as to be arranged in a standing posture. This cassette 18 sequentially sends out the cards Ca by a pickup roller 19, starting from a card Ca in a front row and supplies the sent-out cards Ca from a separation opening 7 to the information recording portion A.

The storage portion D stores the cards Ca conveyed from the printing portion B on a storage stacker 60. The storage stacker 60 is configured to be movable by a lifting and lowering mechanism 61 in a vertical direction in FIG. 3.

The rotation unit F is configured to be rotatable while nipping each of the cards Ca and is disposed on the carrying-in path P1. The rotation unit F conveys each of the cards Ca supplied from the medium supply portion C toward the printing portion B or the information recording portion A, reverses the front or back surface of each of the cards Ca conveyed from the printing portion B, and conveys each of the cards Ca toward the printing portion B again. The rotation unit F conveys each of the cards Ca, onto which information has been recorded by the information recording portion A, toward the printing portion B.

The operation panel portion 5 is an operation display portion and is to issue an instruction of recording operation and the like by user's input operation or the like.

The controller 100 controls operation of the whole image forming apparatus 1.

The power supply portion 120 converts a commercial AC voltage to a DC voltage and supplied the DC voltage to the controller 100, the thermal head 40, the operation panel portion 5, the information recording portion A, and the like.

<Configuration of Information Recording Portion>

A configuration of the information recording portion A of the image forming apparatus 1 according to the first embodiment of the present invention will be described in detail with reference to FIGS. 2 and 3.

The information recording portion A includes a contactless IC recording portion 23, a magnetic recording portion 24, and a contact IC recording portion 27.

The contactless IC recording portion 23 is disposed on an outer periphery of the rotation unit F in such a way as to face the rotation unit F. The contactless IC recording portion 23 performs electric information recording (writing) onto each of the cards Ca conveyed from the rotation unit F in a contactless manner and conveys each of the cards Ca, onto which the electric information recording has been performed, toward the rotation unit F.

The magnetic recording portion 24 is disposed on the outer periphery of the rotation unit F in such a way as to face the rotation unit F. The magnetic recording portion 24 performs magnetic information recording (writing) onto each of the cards Ca conveyed from the rotation unit F and conveys each of the cards Ca, onto which the magnetic information recording has been performed, toward the rotation unit F.

The contact IC recording portion 27 is disposed on the outer periphery of the rotation unit F in such a way as to face the rotation unit F. The contact IC recording portion 27 performs electric information recording (writing) onto each of the cards Ca conveyed from the rotation unit F while contacting each of the cards Ca and conveys each of the cards Ca, onto which the electric information recording has been performed, toward the rotation unit F.

<Configuration of Printing Portion>

A configuration of the printing portion B of the image forming apparatus 1 according to the first embodiment of the present invention will be described in detail with reference to FIGS. 2 to 4.

The printing portion B is constituted of the image forming portion B1 and the transfer portion B2 and includes a conveying roller 29, a conveying roller 30, a transfer platen roller 31, a transfer roller 33, a de-curling mechanism 34, a conveying roller 35, and a pair of conveying rollers 38. In addition, the image forming portion B1 includes a thermal head 40, an ink ribbon cassette 42, an image forming platen roller 45, a transporting roller 49, a re-transfer film set (film set) 50, a sensor Se1, and a sensor Se2.

The conveying roller 29 is disposed on the carrying-in path P1, is coupled to a conveying motor, not illustrated, and is rotatable in a normal rotational direction or a reverse rotational direction by driving of this conveying motor. The conveying roller 29 conveys each of cards Ca conveyed from a rotation unit F toward the conveying roller 30 or conveys each of the cards Ca conveyed from the conveying roller 30 toward the rotation unit F.

The conveying roller 30 is disposed on the carrying-in path P1, is coupled to a conveying motor, not illustrated, and is rotatable in a normal rotational direction or a reverse rotational direction by driving of this conveying motor. The conveying roller 30 conveys each of the cards Ca conveyed from the conveying roller 29 toward between the transfer roller 33 and the transfer platen roller 31 or conveys each of the cards Ca conveyed from between the transfer roller 33 and the transfer platen roller 31 toward the conveying roller 29.

The transfer platen roller 31 is disposed in such a way as to face the transfer roller 33 via a transfer film 46.

The transfer roller 33 is disposed in such a way as to face the transfer platen roller 31 via the transfer film 46. The transfer roller 33 is configured by a heat roller, is pressed against the transfer platen roller 31, and when pressing is unnecessary, is separated from the transfer platen roller 31.

The de-curling mechanism 34 is disposed between the conveying roller 35 and the pair of conveying rollers 38. The de-curling mechanism 34 is constituted of a cam 36 and a de-curling plate 37 as a lifting and lowering mechanism, which is movable in a vertical direction in FIG. 3 with respect to the cam 36. The de-curling mechanism 34 corrects curling of each of the cards Ca, which is caused by heating made by the transfer roller 33, by pressing a central part of each of the cards Ca, which is held by the conveying roller 35 and the pair of conveying rollers 38.

The de-curling plate 37 is disposed on the carrying-out path P2. The cam 36 is coupled to a conveying motor, not illustrated, rotates by driving of this conveying motor, nips each of the cards Ca, which has passed through between the transfer platen roller 31 and the transfer roller 33, and conveys each of the cards Ca to a downstream side in a conveying direction.

The pair of conveying rollers 38 are disposed on the carrying-out path P2. The pair of conveying rollers 38 are coupled to a conveying motor, not illustrated, rotate by driving of this conveying motor, nip each of the cards Ca, which has passed through the de-curling mechanism 34, and convey each of the cards Ca to a storage portion D on a downstream side in the conveying direction of each of the cards Ca (hereinafter, simply referred to as a "conveying direction").

The thermal head 40 is disposed in such a way as to face the image forming platen roller 45 via an ink ribbon 41 and the transfer film 46. The thermal head 40 heats the ink ribbon 41 and forms an image on the transfer film 46 by ink of the ink ribbon 41.

In the ink ribbon cassette 42, the ink ribbon 41 which is a thermal transfer ink ribbon such as a sublimation type ink ribbon is wound between a supply spool 43 and a winding spool 44. The ink ribbon cassette 42 is installed in a housing of the image forming apparatus 1 in a detachably attachable manner.

The supply spool 43 rotates by driving of a motor Mr3 and sends out the ink ribbon 41.

The winding spool 44 rotates by driving of a motor Mr1 and winds the ink ribbon 41.

The image forming platen roller 45 is disposed in such a way as to face the thermal head 40 via the transfer film 46 and the ink ribbon 41. The image forming platen roller 45 runs the transfer film 46 loaded in the re-transfer film set 50.

The transporting roller 49 is coupled to a driving motor, not illustrated, and rotates by driving of this driving motor. The transporting roller 49 rotates, thereby transporting the transfer film 46, onto which the image has been formed by the thermal head 40 and the image forming platen roller 45, toward between the transfer platen roller 31 and the transfer roller 33 together with a pinch roller 32*a* and a pinch roller 32*b* which are disposed on an outer peripheral surface. Here, a width of a heating region of the thermal head 40 is narrower than a width of the transfer film 46 since an image is formed within the transfer film 46.

The re-transfer film set 50 as a film set is installed in the housing 2 in a detachably attachable manner. As illustrated in FIG. 4, the re-transfer film set 50 includes the transfer film 46, a supply spool 48, and a winding spool 47 and winds the transfer film 46 around the supply spool 48 and the winding spool 47.

The supply spool 48 rotates by driving of a motor Mr2, passes through the transfer portion B2, and supplies the transfer film 46 between the thermal head 40 of the image forming portion B1 and the image forming platen roller 45.

The winding spool 47 rotates by driving of a motor Mr4 and winds the transfer film 46 after an image has been transferred onto each of the cards Ca by the transfer platen roller 31 and the transfer roller 33. Note that detail of a configuration of the winding spool 47 will be described later.

The supply spool 48 and the winding spool 47 reciprocate the transfer film 46 in the image forming portion B1 for each of a plurality of colors when a color image is formed on the transfer film 46 and superpose images having the plurality of colors on the transfer film 46, thereby forming the color image.

The sensor Se1 detects a position mark of the transfer film 46 and outputs a detection result to the controller 100.

The sensor Se2 detects a position mark of the ink ribbon 41 and outputs a detection result to the controller 100.

<Configuration of Rotation Unit>

A configuration of the rotation unit F of the image forming apparatus 1 according to the first embodiment of the present invention will be described in detail with reference to FIG. 3.

The rotation unit F includes a pair of rollers 20, and a pair of rollers 21, a pair of carrying-in rollers 22, and a rotation frame 80.

The pair of rollers 20 and the pair of rollers 21 are pivotally supported to the rotation frame 80 in a rotatable manner. The pair of rollers 20 and the pair of rollers 21 constitute a medium conveying passage 65 for conveying each of cards Ca. The pair of rollers 20 and the pair of rollers 21 convey each of the cards Ca conveyed by the pair of carrying-in rollers 22 toward any of the printing portion B or the contactless IC recording portion 23, the magnetic recording portion 24, and the contact IC recording portion 27. The pair of rollers 20 and the pair of rollers 21 convey each of the cards Ca conveyed from any of the contactless IC recording portion 23, the magnetic recording portion 24, and the contact IC recording portion 27 toward the printing portion B.

The pair of carrying-in rollers 22 convey each of the cards Ca supplied from the separation opening 7 of the cassette 18 of a medium supply portion C toward the rotation frame 80.

The rotation frame 80 is bearing-supported to a housing 2 in a rotatable manner.

<Configuration of Controller>

A configuration of the controller 100 of the image forming apparatus 1 according to the first embodiment of the present invention will be described in detail with reference to FIG. 2.

The controller 100 includes a buffer memory 101, a micro computer (hereinafter, referred to as a "microcomputer") 102, a sensor controller 103, an actuator controller 104, a thermal head controller 105, and an operation display controller 106.

In the buffer memory 101, printing data to be printed on each of cards Ca, received from a PC 201, is temporarily stored. In the buffer memory 101, recording data received from the PC 201 and to be recorded in a magnetic stripe of each of the cards Ca, recording data to be magnetically or electrically recorded in an IC is temporarily stored.

The microcomputer 102 performs control processing of the whole image forming apparatus 1. The microcomputer 102 includes a central processing unit, a CPU which operates with a high-speed clock, a ROM in which a control program and the like are stored, a RAM which serves as a work area of the CPU, and an internal bus which connects these, which are not illustrated.

The sensor controller 103 operates by controlling of the microcomputer 102, controls the sensor Se1, the sensor Se2, and the like, and outputs a signal input from the sensor Se1 or the sensor Se2 to the microcomputer 102.

The actuator controller 104 operates by controlling of the microcomputer 102. The actuator controller 104 includes a motor driver which supplies driving pulses and driving power to the motor Mr1, the motor Mr2, the motor Mr3, and the motor Mr4 and drives the motor Mr1, the motor Mr2, the motor Mr3, and the motor Mr4.

The thermal head controller 105 controls thermal energy supplied to the ink ribbon 41 and the transfer film 46 from heater elements, not illustrated, which a thermal head 40 includes.

The operation display controller 106 controls the operation panel portion 5.

<Configuration of Winding Spool>

A configuration of the winding spool 47 of the image forming apparatus 1 according to the first embodiment of the present invention will be described in detail with reference to FIGS. 4 to 10.

Figure 4:
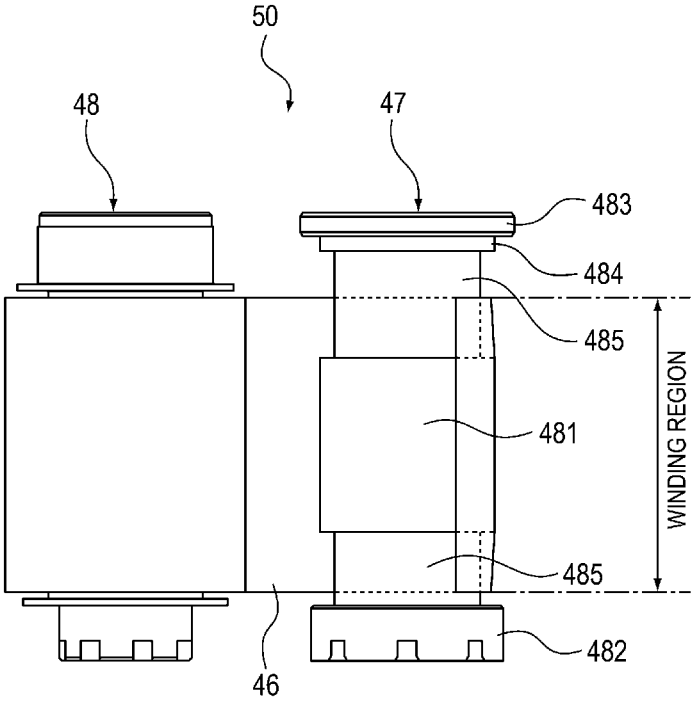
FIG. 4 is a plan view of a re-transfer film set according to the first embodiment of the present invention.
Figure 5:
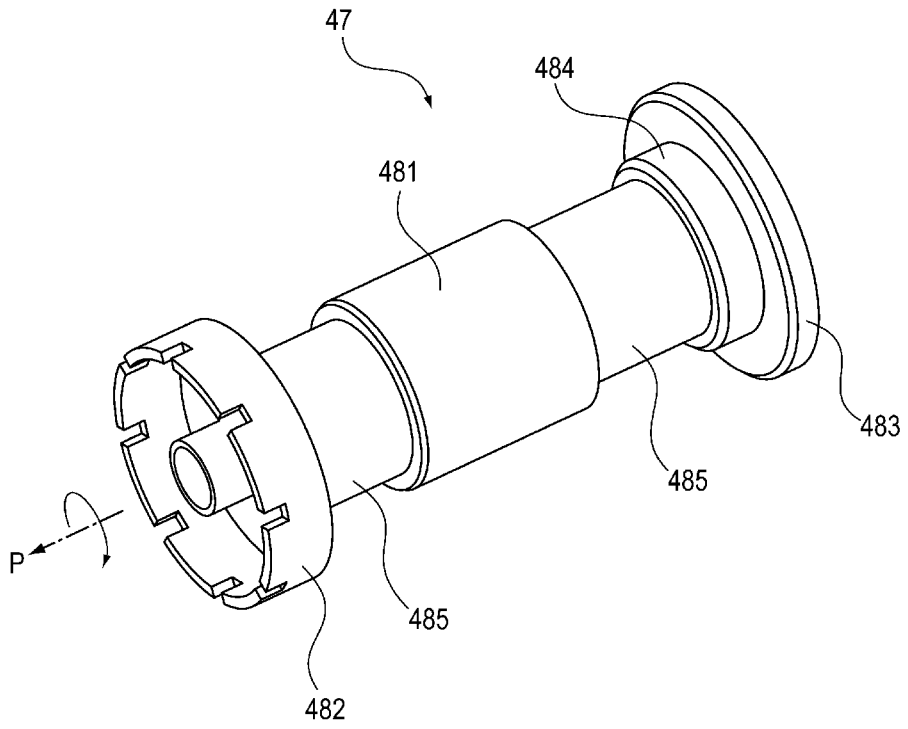
FIG. 5 is a perspective view of a winding spool according to the first embodiment of the present invention.
Figure 6:
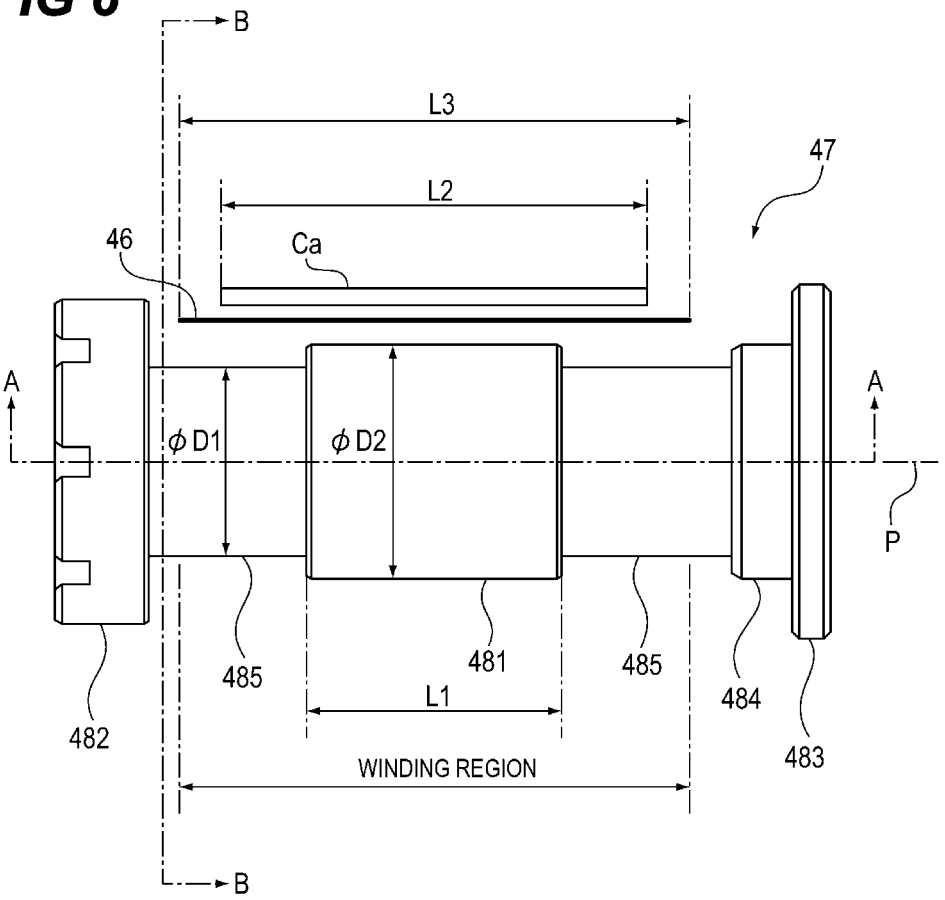
FIG. 6 is a front view of the winding spool according to the first embodiment of the present invention.
Figure 7:
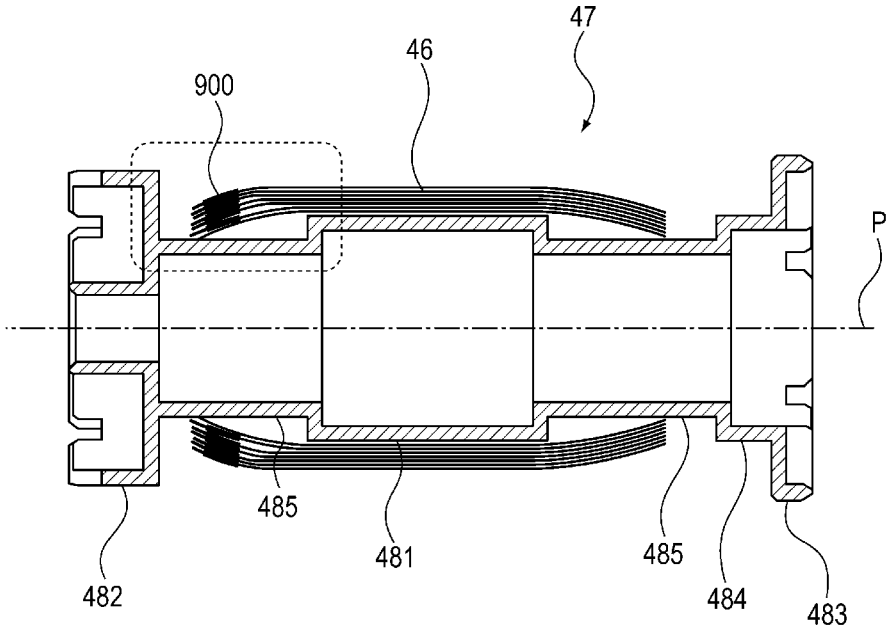
FIG. 7 is an explanatory diagram illustrated by adding a wound film to a cross-sectional view, taken from arrows A-A in FIG. 6.
Figure 8:
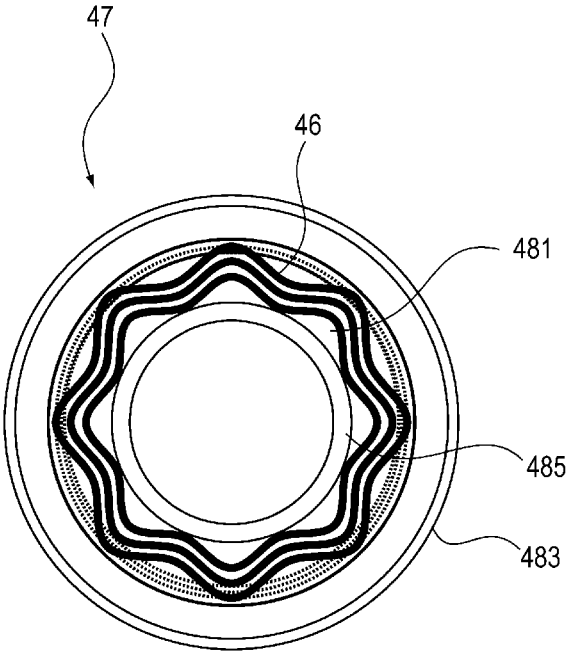
FIG. 8 is an explanatory diagram illustrated by adding the wound film to a cross-sectional view, taken from arrows B-B in FIG. 6.
Figure 9:
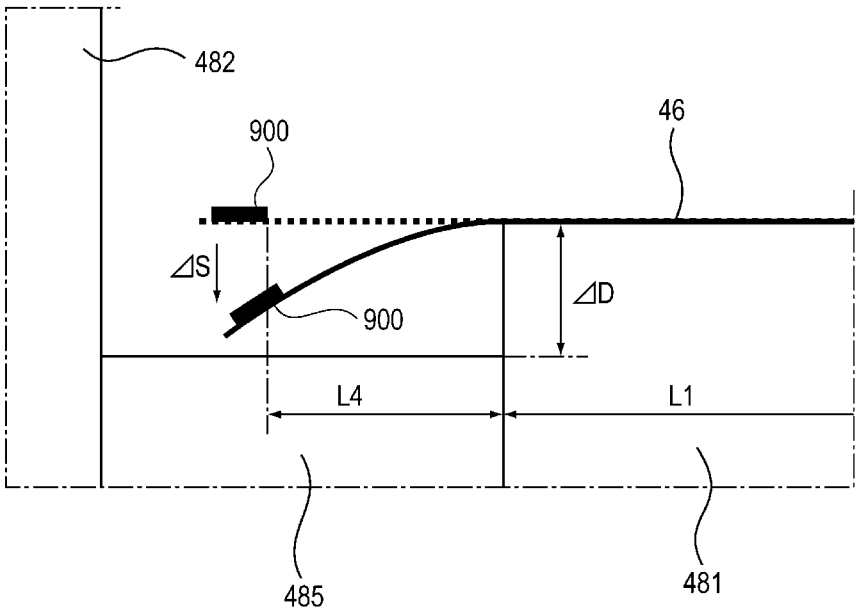
FIG. 9 is a diagram in which one part of the diagram in FIG. 7 is enlarged and an image diagram illustrating a state in which the transfer film is wound once.
Figure 10:
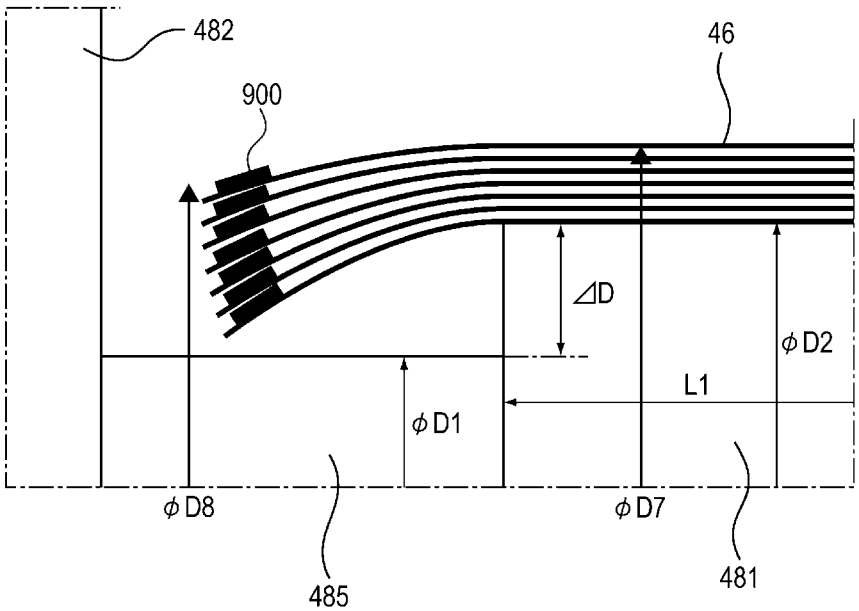
FIG. 10 is a diagram in which one part of the diagram in FIG. 7 is enlarged and is an image diagram illustrating a state in which the transfer film is wound.

FIG. 4 is a plan view of a film set. FIG. 5 is a perspective view of the winding spool. FIG. 6 is a front view of the winding spool. FIG. 7 is an explanatory diagram illustrated by adding a wound film to a cross-sectional view, taken from arrows A-A in FIG. 6. FIG. 8 is an explanatory diagram illustrated by adding the wound film to a cross-sectional view, taken from arrows B-B in FIG. 6. FIG. 9 is a diagram in which one part of the diagram in FIG. 7 is enlarged and an image diagram illustrating a state in which the transfer film is wound once. FIG. 10 is a diagram in which one part of the diagram in FIG. 7 is enlarged and is an image diagram illustrating a state in which the transfer film is wound.

Here, each of cards Ca as a recording medium is a card Ca such as an ID card or a credit card and in general, has an ID-1 size (85.6 mm×53.98 mm) specified by international standard ISO. In addition, it is often the case that the image forming apparatus 1 for the above-mentioned cards Ca is manufactured as a dedicated apparatus in which only cards Ca whose each size is the ID-1 size are used.

A material of a transfer film 46 in the present embodiment is PET (polyethylene terephthalate) and a film thickness thereof is 0.02 mm, and since a number of printable pieces of the transfer film 46 (a number of transferable pieces of the transfer film 46) is 500, a number of pieces thereof from when supplied to when wound is 500.

In the embodiments of the present invention, in order to prevent film biasing caused by ink remaining after transferring, the transfer film 46 in a remaining ink adhesion region where the remaining ink has adhered is not supported from below the winding spool 47. Thus, the transfer film 46 in the remaining ink adhesion region is warped and a film wound outer diameter in the remaining ink adhesion region is made equal to or less than an outer diameter of the whole transfer film 46, thereby preventing the film biasing from occurring. Here, since a remaining ink adhesion region on a front surface of the transfer film 46 is a region where ink formed for marginless printing adheres, the remaining ink adhesion region corresponds to positions of end portions of each of the cards Ca which is subjected to the transferring.

As illustrated in FIG. 4, a leading end portion of the transfer film 46 in an unused state, which extends from a supply spool 48, is attached to the winding spool 47, and the winding spool 47 winds the transfer film 46 supplied by the supply spool 48 while rotating. Specifically, as illustrated in FIG. 5, the winding spool 47 includes a large diameter portion 481, small diameter portions 485, a fitting portion 482, a large flange portion 483, and a small flange portion 484. In a film winding region (see FIG. 6), in order to warp the transfer film 46 in the remaining ink adhesion region, the large diameter portion 481 which winds the transfer film 46 and the small diameter portions 485 which warps the transfer film 46 are disposed. Note that a shape of a region where the film of the supply spool 48 is wound is different from a shape of a region where the film of the winding spool 47 is wound and is straight in the whole region of the film of the supply spool 48 and outer diameters do not change.

As illustrated in FIG. 6 in which a positional relationship of the transfer film 46 and each of the cards Ca with respect to the winding spool 47 is shown, the large diameter portion 481 is disposed in a central part of the film winding region, where the transfer film 46 is wound, in an axial direction (a horizontal direction in FIG. 6) in parallel with a rotational axis P of a winding portion, and the transfer film 46 is wound with the large diameter portion 481 as a center.

As illustrated in FIG. 6, an outer diameter of the large diameter portion 481 is larger than an outer diameter of each of the small diameter portions 485 which are located both ends of the large diameter portion 481 in the axial direction. A length L1 of the large diameter portion 481 in the axial direction is shorter than a length L2 of each of the cards Ca in a width direction which is orthogonal to a conveying direction of each of the cards Ca (L1<L2). A length L3 of the transfer film 46 in the width direction in the present embodiment is 60 mm, and the length L2 of each of the cards Ca in the width direction is 53.98 mm. The length L1 of the large diameter portion 481 in the axial direction in the present embodiment is shorter than the L2 (53.98 mm) and is 30 mm. The length L2 of each of the cards Ca in the width direction is smaller than the length L3 of the transfer film 46 in the width direction and is smaller than a recording width of an ink ribbon 41 where ink for forming an image on the transfer film 46 adheres. Note that in the present invention, since it is only required to satisfy relationship of L1<L2<L3, dimensions thereof are not limited to the above-mentioned dimensions.

As illustrated in FIGS. 7 and 8, since the length L1 of the large diameter portion 481 in the axial direction is smaller than the length L3 of the transfer film 46 in the width direction, end portions of the warped transfer film 46 in the width direction protrudes to sides of the small diameter portions 485 in protruding amounts in which the end portions thereof do not contact the small diameter portions 485. The large diameter portion 481 protrudes in a position of the winding portion in the axial direction where the end portions of the transfer film 46 in the width direction are warped when remaining ink 900 has adhered in positions, each of which is the remaining ink adhesion region of the transfer film 46 and which corresponds to an end portion of each of the cards Ca.

In the present embodiment, a winding outer diameter of the transfer film 46 in the remaining ink adhesion region where the remaining ink has adhered is set to be equal to or less than outer diameters of the transfer film 46 in regions other than the remaining ink adhesion region, and an end portion of the transfer film 46 is warped. A warping amount of the transfer film 46 required for this is determined by a length of a distance L4 (see FIG. 9) from the end portion of the large diameter portion 481 in the axial direction up to a position of the transfer film 46 prior to warping, where contacting of the end portion of each of the cards Ca is brought about.

Although the distance L4 in the present embodiment is 12 mm, since the distance L4 changes depending on a material and a thickness of the transfer film 46, it is preferable that the distance L4 is 4.5 mm or more.

Although the length L1 in the present embodiment is 30 mm, it is preferable that the length L1 is 4.5 mm or more. It is preferable that a range of the length L1 of the large diameter portion 481 in consideration of the L4 is 20 mm to 45 mm. Here, the reason why it is preferable that the length L1 of the large diameter portion 481 is 20 mm or more will be described. As to a winding direction in which the winding spool 47 winds the transfer film 46, the leading end portion of the transfer film 46 is adhered to the large diameter portion 481 of the winding spool 47 by an adhesive. This allows the winding spool 47 to wind the transfer film 46. Here, if the length L1 of the large diameter portion 481 is smaller than 20 mm, a sufficient adhesion region of the winding spool 47 with the leading end portion of the transfer film 46 cannot be ensured, whereby it is likely that when the winding spool 47 winds the transfer film 46, the transfer film 46 is peeled from the winding spool 47.

Accordingly, it is preferable that the length L1 of the large diameter portion 481 is 20 mm or more. In addition, if the length L1 exceeds 45 mm, because a width L3 of the transfer film 46 is approximately 54 mm, the L4 is less than 4.5 mm and the remaining ink adhesion region where the remaining ink has adhered, which is the end portion of the transfer film 46 in the width direction, is hardly warped to a side of the rotational axis P, and thus, it is preferable that the length L1 is 45 mm or less.

It is preferable that a width of the transfer film 46 is 3 mm to 20 mm larger than a width of each of the cards Ca. This is because the width L3 of the transfer film 46 is larger than a width L2 of each of the cards Ca since the marginless printing is performed. In addition, when it is considered that the transfer film 46 is deviated with respect to a conveying passage, although the larger the width of the transfer film 46 is, the more room is allowed for conveying of the transfer film 46, in consideration of costs of the transfer film 46, there is a limit. Therefore, it is preferable that the width of the transfer film 46 is at least 3 mm to 20 mm larger than the width of each of the cards Ca.

Each of the small diameter portions 485 has a cylindrical shape and an outer diameter of each thereof in the axial direction is $\phi D1$. The outer diameter of each of the small diameter portions 485 is smaller than an outer diameter of the large diameter portion 481 ($\phi D1<\phi D2$) and the small diameter portions 485 are disposed between the large diameter portion 481 and the fitting portion 482 and between the large diameter portion 481 and the small flange portion 484. The outer diameter $\phi D1$ in the present embodiment is 22 mm and the outer diameter $\phi D2$ of the large diameter portion 481 is 30 mm. Here, it is preferable that a range of the outer diameter $\phi D2$ is 20 mm to 40 mm. If the outer diameter $\phi D2$ is smaller than 20 mm, it is required to increase a number of rotations of the winding spool 47, and if the outer diameter $\phi D2$ is larger than 40 mm, it is required to avoid interference with other components upon maximum winding of the film, thereby leading to an increase in a size of the apparatus.

Here, conditions under which a step difference $\Delta D$ ($\Delta D=(\phi D2-\phi D1)/2$) between the outer diameter $\phi D2$ of the large diameter portion 481 and the outer diameter $\phi D1$ of the small diameter portions 485 is set will be described with reference to FIGS. 9 and 10. Note that FIG. 9 illustrates a state before the transfer film 46 is layered. In addition, in FIG. 9, a broken line indicates the transfer film 46 before warping, and a solid line indicates the transfer film 46 after warping.

FIG. 10 illustrates a state in which the transfer film 46 is wound and layered.

The winding spool 47 is provided with the step difference $\Delta D$, thereby causing a member, which supports the end portion of the transfer film 46 wound the winding portion in the width direction, to be absent. Thus, the end portion (ink adhesion part) of the transfer film 46 to which the remaining ink 900 has adhered is warped by a dropping amount $\Delta S$ (see FIG. 9). The large diameter portion 481 is disposed in such a way as to have the step difference $\Delta D$ to make an outer diameter D8 of an ink layered part smaller than an outer diameter D7 of the transfer film 46 wound to the large diameter portion 481 by a set number of prints (500 prints in the present embodiment) (see FIG. 10).

Here, the step difference $\Delta D$ made in a boundary between the outer diameter 401 of the small diameter portion 485 and the outer diameter $\phi D2$ of the large diameter portion 481 may be changed by the length of the distance L4 (see FIG. 9) from the end portion of the large diameter portion 481 in the axial direction up to the end portion of the transfer film 46 in the width direction. Note that parts portions of the boundary between the large diameter portion 481 and the small diameter portions 485 are parts whose outer diameters vary and are also parts whose diameters are different.

Although a difference (the step difference $\Delta D$) between a height of the large diameter portion 481 and a height of the small diameter portion 485 is 4 mm in the present embodiment, it is preferable that the difference is 1 mm or more. This is because when the step difference $\Delta D$ is 1 mm or more, the remaining ink region of the transfer film 46 can be warped. Note that the end portion of the warped transfer film 46 may contact or may not contact the small diameter portion 485. However, when the end portion of the warped transfer film 46 contacts the small diameter portion 485, the contacting is made on a condition that the outer diameter of the transfer film 46 in the remaining ink region is the same as the outer diameter of the central part of the transfer film 46 or is equal to or less than the outer diameter of the central part of the transfer film 46. Although the larger the step difference $\Delta D$ is, the more room is allowed for warping of the transfer film 46, if the step difference $\Delta D$ is excessively large, problems of strength and the like arise upon molding the step difference $\Delta D$. For example, if the large diameter portion 481 is formed in a shape of ribs (ribs in the later-described second embodiment), the higher a height of each of the ribs is, the narrower a width of each of the ribs is due to an extraction taper, thereby leading to a decrease in strength of the ribs and a decrease in an adhering area.

Note that a corner part of the large diameter portion 481 contacting the transfer film 46 may be chamfered, rounded, or cornered. In addition, a corner part in which the large diameter portion 481 and the small diameter portions 485 are connected may be rounded, be a smooth curved surface, or be of a tapered shape.

Since the dropping amount $\Delta S$ of the transfer film 46 is determined by the distance L4 and the step difference $\Delta D$, effect attained by the present embodiment is that when an amount of the step difference $\Delta D$ (4 mm in the present embodiment) is an amount or more required for the dropping amount $\Delta S$, even if the step difference $\Delta D$ is made large, no film biasing is caused.

Here, the large diameter portion 481 has the cylindrical shape whose outer diameter is $\phi D2$, and although it is preferable that the external shape thereof is a straight shape whose external dimensions in the axial direction are the same, when the large diameter portion 481 has outer diameters whose shape is a crown shape or a reversed crown shape, since the winding spool 47 is normally driven and reversely driven in a repeated manner for transferring by printing and the transfer film 46 is conveyed in a manner reciprocated many times, it is preferable that a crown amount of the large diameter portion 481 is small. In addition, since the crown amount exerts influence on adhesion force when the transfer film 46 is caused to adhere to the large diameter portion 481, it is preferable that the crown amount is small.

The fitting portion 482 has a diameter larger than the diameter of the large diameter portion 481 and is disposed on one end of the winding spool 47 in the axial direction. The fitting portion 482 is formed in such a way as to be outwardly protruded and recessed along the axial direction. The fitting portion 482 is fitted to a counterpart fitting portion of the motor Mr4, not illustrated, and rotates the winding spool 47 by rotation of the motor Mr4.

The large flange portion 483 has a diameter larger than the diameter of the large diameter portion 481 and is disposed on another end of the winding spool 47 in the axial direction. The large flange portion 483 rotatably engages with an engagement portion of the housing 2, not illustrated.

The small flange portion 484 has a diameter smaller than the diameter of the large flange portion 483 and is disposed between the small diameter portions 485 and the large flange portion 483.

Here, when biasing of the film which moves in the axial direction while the thin transfer film 46 is butted against the large flange portion 483 or the small flange portion 484 is regulated, since it is likely that the transfer film 46 which has contacted the flange is damaged, the flange is separated from the transfer film 46 so as to avoid contacting of the transfer film 46 with the flange even when the transfer film 46 moves in the axial direction of the spool upon winding the film.

<Operation of Winding Spool>

Operation of the winding spool 47 of the image forming apparatus 1 according to the first embodiment of the present invention will be described in detail with reference to FIGS. 4 to 10.

In a case, in which the so-called marginless printing is performed, or the like, on a transfer film 46 which is wound onto a winding spool 47 in a state in which ink remains in a specific portion such as one end portion of each card Ca in a width direction, the remaining ink 900 remaining on the transfer film 46 is layered together therewith. Here, an ink material of an ink ribbon 41 in the present embodiment is pigment ink. When this pigment ink is used, an increase in an outer diameter of the transfer film 46 due to remaining ink is large, as compared with dye ink which permeates into a receiving layer of the transfer film 46.

As illustrated in FIG. 7, parts of the transfer film 46, on which the remaining ink 900 is not layered, are wound onto a large diameter portion 481 in such a way that parts of the transfer film 46, on which the remaining ink 900 is layered, do not contact a small diameter portion 485.

The parts of the transfer film 46, on which the remaining ink 900 is layered, is not supported by the winding spool 47 and as illustrated in FIG. 8, fall down to a side of the small diameter portion 485 in a waving-like shape. Accordingly, outer diameters of the parts of the transfer film 46 which have fallen down to the side of the small diameter portion 485, on which the remaining ink 900 is layered, are smaller than the other parts thereof.

When the transfer film 46 is layered, parts of the transfer film 46, whose outer diameters are maximum, are parts which are wound onto the large diameter portion 481 as a central part thereof in the axial direction. In addition, since a length L1 of the large diameter portion 481 in the axial direction is narrower than a width L2 of each card Ca, the parts of the transfer film 46 which are wound onto the large diameter portion 481 are not influenced by layering of the remaining ink 900 and no difference in outer diameters attributable to the layering of the remaining ink 900 is caused. Accordingly, film biasing of the transfer film 46 caused by an increase in outer diameters of a film end portion can be prevented.

In the present embodiment, the transfer film 46 is wound by the winding spool 47 including the large diameter portion 481 which is disposed in a central part of a winding region in the axial direction, whose diameter is larger than diameters of end portions thereof in the axial direction, and whose length L1 in the axial direction is shorter than a length L2 of each card Ca in a width direction. Thus, as compared with the dye ink which permeates into the receiving layer of the transfer film 46, biasing of the transfer film 46 attributable to the remaining ink 900 which has remained on the transfer film 46 using the pigment ink can be prevented in a simple configuration in which small diameter portions are disposed in end portions of the large diameter portion without increasing costs.

Second Embodiment

Figure 2:
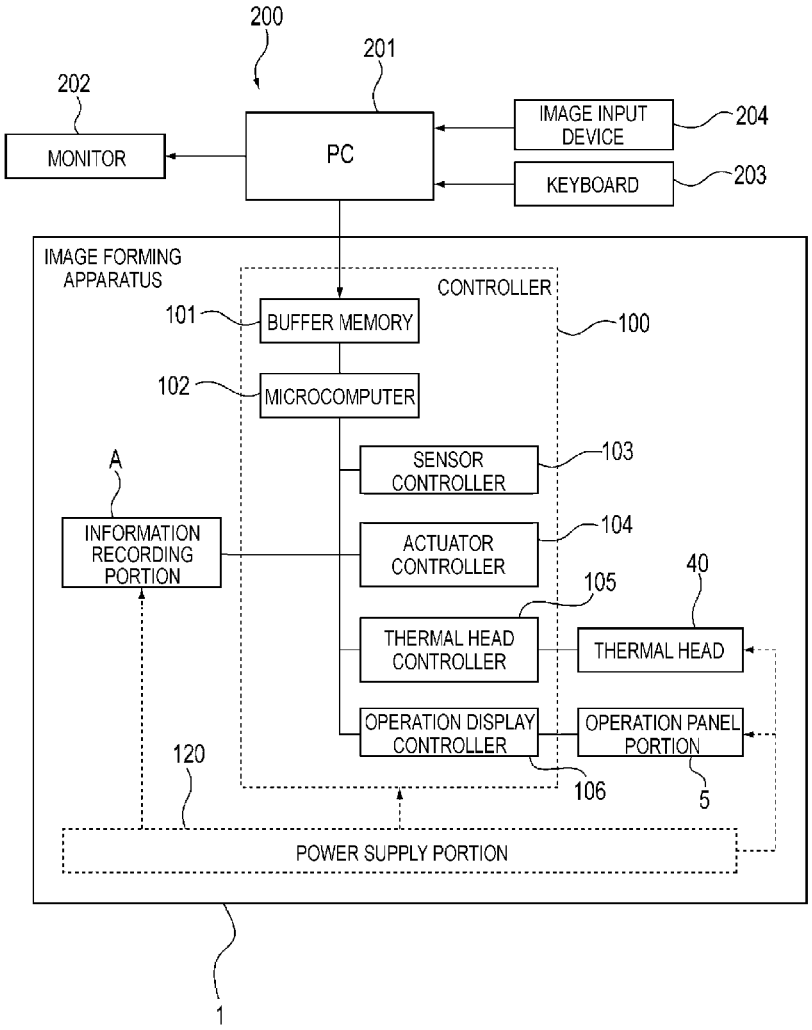
FIG. 2 is a block diagram illustrating a configuration of the image forming system according to the first embodiment of the present invention.
Figure 3:
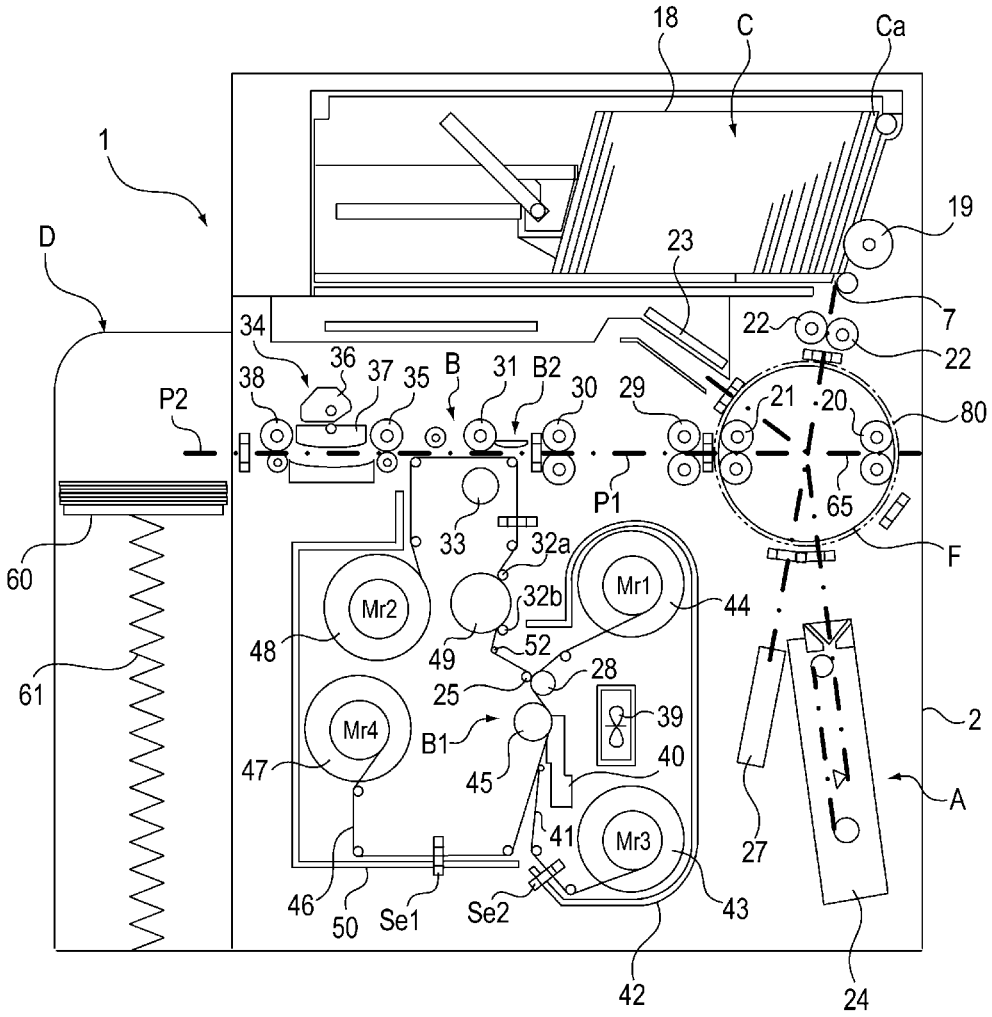
FIG. 3 is a schematic view illustrating a configuration of an image forming apparatus according to the first embodiment of the present invention.

Since an image forming apparatus according to a second embodiment of the present invention has the same configuration as the configuration illustrated in FIGS. 1 to 3, description therefor will be omitted. In addition, since a re-transfer film set of the image forming apparatus according to the present embodiment has the same configuration as the configuration illustrated in FIG. 4 except that a winding spool 148 is disposed, instead of a winding spool 47, description for a part other than the winding spool 148 will be omitted.

<Configuration of Winding Spool>

A configuration of the winding spool 148 of the image forming apparatus according to the second embodiment of the present invention will be described in detail with reference to FIGS. 11 and 12.

Figure 11:
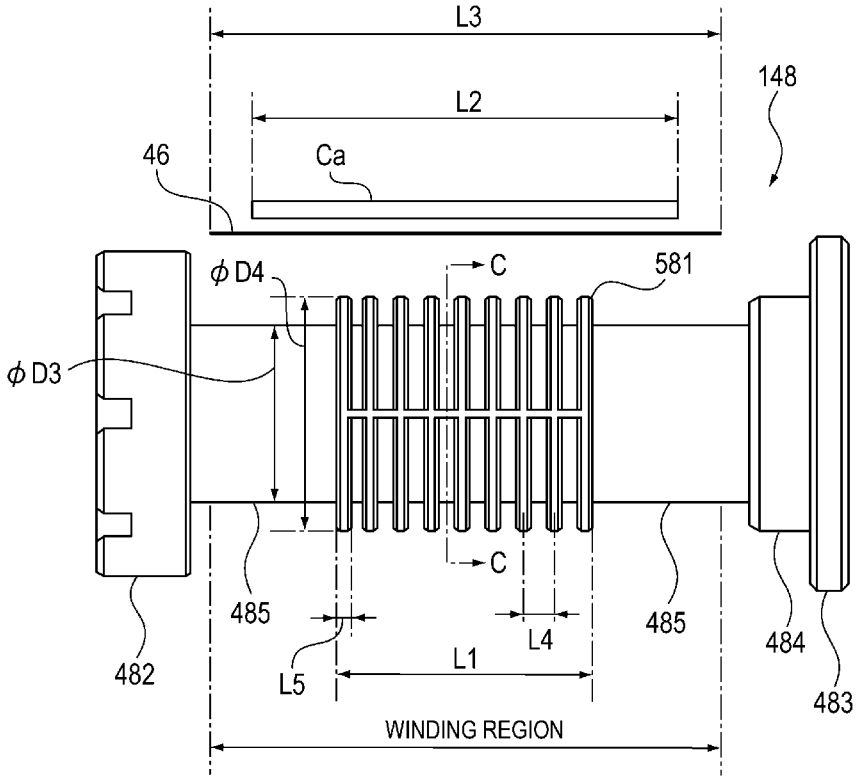
FIG. 11 is a front view of a winding spool according to a second embodiment of the present invention.
Figure 12:
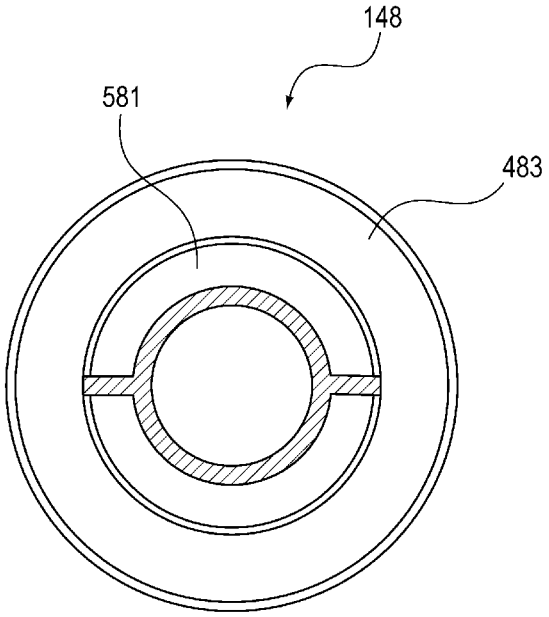
FIG. 12 is a cross-sectional view, taken from arrows C-C in FIG. 11.

Note that in FIGS. 11 and 12, the same components as those illustrated in FIGS. 5 to 8 are denoted by the same reference signs and description therefor will be omitted.

In the second embodiment, instead of a large diameter portion 481 in the first embodiment, a winding portion 581 is formed by a plurality of ribs which protrude in a circumferential direction from a winding spool. Thus, whereas a winding spool 47 in the first embodiment is formed by dividing the winding spool 47 into a plurality of components and thereafter, integrating the components, it does not occurs that a thickness of the winding portion 581 is partially large by the plurality of ribs, and the winding portion 581 can be molded only by using a sliding type winding portion for one part thereof, thereby allowing a reduction in manufacturing costs of a winding spool 148.

As illustrated in FIG. 11 in which a positional relationship of a transfer film 46 and each card Ca with respect to the winding spool 148 is shown, the winding spool 148 includes a fitting portion 482, a large flange portion 483, a small flange portion 484, small diameter portions 485, and the winding portion 581, and in a film winding region, the winding portion 581 constituted of the plurality of ribs and the small diameter portions 485 are disposed.

The winding portion 581 constituted of the plurality of ribs is disposed in a central part of the winding portion, onto which the transfer film 46 is wound, in an axial direction in parallel with a rotational axis P of the winding portion (in a horizontal direction in FIG. 11). The winding portion 581 is formed by outwardly protruding the plurality of ribs along the axial direction and a circumferential direction with the axial direction as a center. The winding portion 581 has a cylindrical shape whose each of the same diameters in the axial direction is $\phi D4$. The diameter $\phi D4$ is, for example, is 30 mm. The plurality of ribs of the winding portion 581 protrudes outwardly in the circumferential direction from the winding spool 148 and is arrayed in the axial direction. A length between ribs which are located in both ends in the axial direction is shorter than a length L2 of each card Ca in a width direction.

In the present embodiment, although a rib pitch of the winding portion 581 is 3.8 mm, it is preferable that the rib pitch is 2 mm to 9 mm. In addition, although in the present embodiment, a rib width is 1.6 mm, it is preferable that the rib width is 1 mm to 3 mm. This is because since upon manufacturing a film set, an end portion of the transfer film 46 is adhered onto the winding spool 47 and a wide adhering area of an adhesive is desirable, it is preferable that the rib pitch is narrow. In addition, although a wide adhering area of the rib width is also desirable, it is preferable that the rib width is 1 mm to 3 mm in order to avoid a problem such as a sink caused by a large thickness upon molding.

A diameter of the winding portion 581 in each end portion of the winding portion in the axial direction is larger than a diameter of each of the small diameter portions 485. A length L1 of the winding portion 581 in the axial direction is shorter than the length L2 of each card Ca in the width direction (L1<L2). In the present embodiment, a length L3 of the transfer film 46 in a width direction is 60 mm, the length L2 of each card Ca in the width direction is 53.98 mm, and the length L1 of the winding portion 581 in the axial direction is 30 mm. In addition, the diameter ϕD3 of each of the small diameter portions 485 is 22 mm.

The winding portion 581 protrudes from the small diameter portions 485 in a protruding amount in which an end portion of the warped transfer film 46 in the width direction does not contact the small diameter portions 485.

Note that since a condition under which a step difference ΔD (ΔD=(ϕD4−ϕD3)/2) between an outer diameter ϕD4 of the winding portion 581 and the outer diameter ϕD3 of each of the small diameter portions 485 is set in the present embodiment is the same as that in the first embodiment, description therefor will be omitted. In addition, since operation of the winding spool 148 of the image forming apparatus according to the present embodiment is the same as the above-described operation of the winding spool 47, description therefor will be omitted.

Third Embodiment

Since an image forming apparatus according to a third embodiment of the present invention has the same configuration as the configuration illustrated in FIGS. 1 to 3, description therefor will be omitted. In addition, since a re-transfer film set of the image forming apparatus according to the present embodiment has the same configuration as the configuration illustrated in FIG. 4 except that a winding spool 248 is disposed, instead of a winding spool 47, description for a part other than the winding spool 248 will be omitted.

<Configuration of Winding Spool>

A configuration of the winding spool 248 of the image forming apparatus according to the third embodiment of the present invention will be described in detail with reference to FIG. 13.

Figure 13:
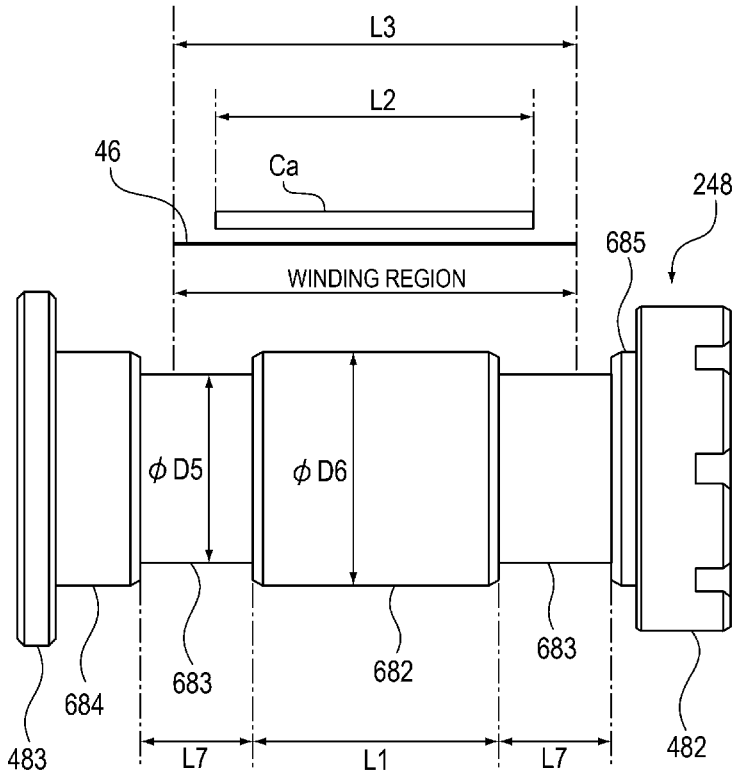
FIG. 13 is a front view of a winding spool according to a third embodiment of the present invention.

Note that in FIG. 13, the same components as those illustrated in FIGS. 5 to 8 are denoted by the same reference signs and description therefor will be omitted.

As illustrated in FIG. 13 in which a positional relationship of a transfer film 46 and each card Ca with respect to the winding spool 248 is shown, the winding spool 248 includes a fitting portion 482, a large flange portion 483, a coupling portion 682 which couples the fitting portion 482 and the large flange portion 483, and groove-shaped recessed portions 683 in both ends of the coupling portion 682. The winding region (see FIG. 13) where a transfer film 46 is wound is configured by the coupling portion 682 and the two recessed portions 683. Note that the winding spool 248 has a small flange portion 684 and a small flange portion 685.

The coupling portion 682 is disposed in a central part of the winding region where the transfer film 46 is wound in an axial direction (a horizontal direction in FIG. 13) in parallel with a rotational axis P of the winding portion. The coupling portion 682 has a cylindrical shape whose each of the same diameters in the axial direction is ϕD6. The outer diameters ϕD6 in the present embodiment are 30 mm.

A diameter of the coupling portion 682 is larger than a diameter of each of the recessed portions 683 in both end portions of the winding region in the axial direction. A length L1 of the coupling portion 682 in the axial direction is shorter than a length L2 of each of the cards Ca in a width direction which is orthogonal to a conveying direction of each of the cards Ca (L1<L2). A length L3 of the transfer film 46 in the width direction is 60 mm, the length L2 of each card Ca in the width direction is 53.98 mm, and the length L1 of the coupling portion 682 in the axial direction is shorter than the L2 (53.98 mm) and is 30 mm. Note that dimensions in the present embodiment are not limited to the above-mentioned dimensions and since it is only required to satisfy L1<L2, the above-mentioned dimensions change according to a thickness, a width, or the like of the transfer film 46.

Each of the groove-shaped recessed portions 683 has a width and a depth which do not allow contacting of an end portion of the warped transfer film 46 in the width direction.

Each of the groove-shaped recessed portions 683 has a cylindrical shape whose each of the same diameters in the axial direction is ϕD5. The outer diameter ϕD5 in the present embodiment is 22 mm.

Note that since a condition under which a step difference ΔD (ΔD=(ϕD6−ϕD5)/2) between an outer diameter ϕD6 of the coupling portion 682 and the outer diameter ϕD5 of each of the recessed portions 683 is set in the present embodiment is the same as that in the first embodiment, description therefor will be omitted. In addition, since operation of the winding spool 248 of the image forming apparatus according to the present embodiment is the same as the above-described operation of the winding spool 47, description therefor will be omitted.

In the present embodiment, in positions which face end portions of the winding portion in the axial direction in parallel with a rotational axis of the transfer film 46 to be wound, the groove-shaped recessed portions 683 are disposed along outer peripheries. Thus, biasing of the transfer film 46 attributable to remaining ink 900 on the transfer film 46 can be prevented in a simple configuration without increasing costs.

The present invention is not limited to the above-described embodiments, and it is needless to say that a variety of modifications can be made without departing from the scope of the present invention.

The present invention is useful in a case where remaining ink does not permeate into film and thicknesses of film winding diameters vary between positions where the remaining ink is present and positions where the remaining ink is absent. Therefore, each of the spool shapes in the present embodiments is effective as a shape of a winding spool of a re-transfer film using pigment ink, instead of dye ink. However, the present invention is not limited to the transfer film for the pigment ink, and it is needless to say that the present invention is effective when film biasing is caused by presence of an adhering substance on the transfer film.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A re-transfer film set comprising:

a belt-like re-transfer film which carries an image being transferred from an ink ribbon, is operable to transfer the image to a recording medium, and has a predetermined width;

a supply spool which has wound the re-transfer film in such a way as to be operable to send out the re-transfer film to a direction being orthogonal to a direction of the width; and a winding spool which is operable to wind the re-transfer film being sent out from the supply spool while rotating around a rotational axis as a center, the winding spool including:

a first outer diameter portion which supports the re-transfer film and has a first outer diameter, a width of the first outer diameter portion in a direction of the rotational axis being narrower than the width of the re-transfer film;

a second outer diameter portion being disposed in the direction of the rotational axis in a position being different from a position of the first outer diameter portion, the second outer diameter portion having a second outer diameter being smaller than the first outer diameter; and a third outer diameter portion being disposed in the direction of the rotational axis on a side opposite to a side of the second outer diameter portion with respect to the first outer diameter portion, the third outer diameter portion having a third outer diameter being smaller than the first outer diameter, wherein when the re-transfer film being supported by the first outer diameter portion is wound onto the winding spool, in the direction of the rotational axis, one end portion of the re-transfer film in the direction of the width overlaps the second outer diameter portion and another end portion of the re-transfer film in the direction of the width overlaps the third outer diameter portion.

2. The re-transfer film set according to claim 1, wherein in the direction of the rotational axis, the first outer diameter of the first outer diameter portion is continuous.

3. The re-transfer film set according to claim 1, wherein the width of the first outer diameter portion in the direction of the rotational axis is 20 mm or more and 45 mm or less.

4. The re-transfer film set according to claim 1, wherein the first outer diameter is 20 mm or more and 40 mm or less.

5. The re-transfer film set according to claim 1, wherein the second outer diameter portion and the third outer diameter portion are groove-shaped recessed portions.

6. The re-transfer film set according to claim 1, wherein corner parts of both end portions of the first outer diameter portion in the rotational axis direction are chamfered.

7. The re-transfer film set according to claim 1, wherein the corner parts of the both end portions of the first outer diameter portion in the rotational axis direction are curved surfaces.

8. The re-transfer film set according to claim 1, wherein in the rotational axis direction, corner parts of the first outer diameter portion and the second outer diameter portion are connected by a curved surface and corner parts of the first outer diameter portion and the third outer diameter portion are connected by a curved surface.

9. The re-transfer film set according to claim 1, wherein in the rotational axis direction, the corner parts of the first outer diameter portion and the second outer diameter portion are connected in a tapered shape and the corner parts of the first outer diameter portion and the third outer diameter portion are connected in a tapered shape.

10. The re-transfer film set according to claim 1, wherein each of a difference between the first outer diameter and the second outer diameter and a difference between the first outer diameter and the third outer diameter is 1 mm or more and 10 mm or less.

11. The re-transfer film set according to claim 1, wherein in the rotational axis direction, the winding spool has a flange outside the second outer diameter portion and a flange outside the third outer diameter portion.

12. The re-transfer film set according to claim 1, wherein a shape of the supply spool is different from a shape of the winding spool.

13. The re-transfer film set according to claim 12, wherein the supply spool has a shape in which two flanges are connected by a shaft having same diameters, the shaft being disposed between the two flanges.

14. An image forming apparatus comprising:

the re-transfer film set according to claim 1;

an ink ribbon;

an ink transfer portion which transfers ink from the ink ribbon onto the re-transfer film being supplied from the re-transfer film set and forms an image on the re-transfer film; and an image transfer portion which transfers the image being formed on the re-transfer film to a recording medium, wherein the winding spool winds the re-transfer film after the image has been transferred to the recording medium by the image transfer portion.

15. The image forming apparatus according to claim 14, wherein the ink of the ink ribbon is pigment ink.

16. The image forming apparatus according to claim 14, wherein a width of the re-transfer film is longer than a width of the recording medium, to which the image is transferred, in a corresponding direction.

17. The image forming apparatus according to claim 16, wherein a difference between a width of the first outer diameter portion in the rotational axis direction and the width of the recording medium in the corresponding direction is 4.5 mm or more.

18. The image forming apparatus according to claim 14, wherein on the winding spool, an outer diameter of the re-transfer film being wound onto the second outer diameter portion and an outer diameter of the re-transfer film wound onto the third outer diameter portion are smaller than an outer diameter of the re-transfer film wound onto the first outer diameter portion.

19. The image forming apparatus according to claim 14, wherein on the winding spool, the wound re-transfer film does not contact the second outer diameter portion and the third outer diameter portion.

20. A re-transfer film set comprising:

a belt-like re-transfer film which carries an image being transferred from an ink ribbon, is operable to transfer the image to a recording medium, and has a predetermined width;

a supply spool which has wound the re-transfer film in such a way as to be operable to send out the re-transfer film to a direction being orthogonal to a direction of the width; and a winding spool which is operable to wind the re-transfer film being sent out from the supply spool while rotating around a rotational axis as a center, the winding spool including:

a first outer diameter portion which supports the re-transfer film and includes a plurality of protruded portions being arrayed in a direction of the rotational axis, each of the protruded portions having a first outer diameter, an interval between the protruded portions, which are located in both ends in the direction of the rotational axis, being narrower than the width of the re-transfer film;

a second outer diameter portion being disposed in the direction of the rotational axis in a position being different from a position of the first outer diameter portion, the second outer diameter portion having a second outer diameter being smaller than the first outer diameter; and a third outer diameter portion being disposed in the direction of the rotational axis on a side opposite to a side of the second outer diameter portion in such a way that the third outer diameter portion and the second outer diameter portion sandwich the first outer diameter portion, the third outer diameter portion having a third outer diameter being smaller than the first outer diameter, wherein when the re-transfer film being supported by the first outer diameter portion is wound onto the winding spool, in the direction of the rotational axis, one end portion of the re-transfer film in the direction of the width overlaps the second outer diameter portion and another end portion of the re-transfer film in the direction of the width overlaps the third outer diameter portion.

21. The re-transfer film set according to claim 20, wherein the protruded portions are arrayed in the direction of the rotational axis at a pitch being 2 mm or more and 9 mm or less.

22. The re-transfer film set according to claim 20, wherein a width of each of the protruded portions in the direction of the rotational axis is 1 mm or more and 3 mm or less.

23. The re-transfer film set according to claim 20, wherein the interval between the protruded portions being located in the both ends in the direction of the rotational axis is 20 mm or more and 45 mm or less.

24. A winding spool which winds a belt-like re-transfer film while rotating around a rotational axis as a center, the belt-like re-transfer film carrying an image being transferred from an ink ribbon, being operable to transfer the image to a recording medium, and having a predetermined width, the winding spool comprising:

a first outer diameter portion which supports the film and has a first outer diameter, a width of the first outer diameter portion in a direction of the rotational axis being narrower than a width of the film, the width of the first outer diameter portion in the direction of the rotational axis being 20 mm or more and 45 mm or less;

a second outer diameter portion being disposed in the direction of the rotational axis in a position being different from a position of the first outer diameter portion, the second outer diameter portion having a second outer diameter being smaller than the first outer diameter; and a third outer diameter portion being disposed in the direction of the rotational axis on a side opposite to a side of the second outer diameter portion with respect to the first outer diameter portion, the third outer diameter portion having a third outer diameter being smaller than the first outer diameter, wherein when the film being supported by the first outer diameter portion is wound onto the winding spool, in the direction of the rotational axis, one end portion of the film in a direction of the width overlaps the second outer diameter portion and another end portion of the film in the direction of the width overlaps the third outer diameter portion.

25. A winding spool which winds a belt-like re-transfer film while rotating around a rotational axis as a center, the belt-like re-transfer film carrying an image being transferred from an ink ribbon, being operable to transfer the image to a recording medium, and having a predetermined width, the winding spool comprising:

a first outer diameter portion which supports the film and includes a plurality of protruded portions being arrayed in a direction of the rotational axis, each of the protruded portions having a first outer diameter, an interval between the protruded portions, which are located in both ends in the direction of the rotational axis, being narrower than the width of the film, wherein the interval between the protruded portions is 20 mm or more and 45 mm or less;

a second outer diameter portion being disposed in the direction of the rotational axis in a position being different from a position of the first outer diameter portion, the second outer diameter portion having a second outer diameter being smaller than the first outer diameter; and a third outer diameter portion being disposed in the direction of the rotational axis on a side opposite to a side of the second outer diameter portion in such a way that the third outer diameter portion and the second outer diameter portion sandwich the first outer diameter portion, the third outer diameter portion having a third outer diameter being smaller than the first outer diameter, wherein when the film being supported by the first outer diameter portion is wound onto the winding spool, in the direction of the rotational axis, one end portion of the film in a direction of the width overlaps the second outer diameter portion and another end portion of the film in the direction of the width overlaps the third outer diameter portion.

* * * * *